US009976702B2

(12) United States Patent
Lamiable et al.

(10) Patent No.: US 9,976,702 B2
(45) Date of Patent: May 22, 2018

(54) COVER FOR GAS CYLINDER TAP

(71) Applicant: Luxembourg Patent Company S.A., Lintgen (LU)

(72) Inventors: Morgan Lamiable, Metzervisse (FR); Jean-Claude Schmitz, Heisdorf (LU)

(73) Assignee: Luxembourg Patent Company S.A., Lintgen (LU)

( * ) Notice: Subject to any disclaimer, the term of this patent is extended or adjusted under 35 U.S.C. 154(b) by 0 days. days.

(21) Appl. No.: 15/123,283

(22) PCT Filed: Feb. 23, 2015

(86) PCT No.: PCT/EP2015/053738

§ 371 (c)(1),
(2) Date: Sep. 2, 2016

(87) PCT Pub. No.: WO2015/132092

PCT Pub. Date: Sep. 11, 2015

(65) Prior Publication Data

US 2017/0067601 A1 Mar. 9, 2017

(30) Foreign Application Priority Data

Mar. 3, 2014 (LU) ..... 92388

(51) Int. Cl.
*F17C 13/00* (2006.01)

(52) U.S. Cl.
CPC .... *F17C 13/002* (2013.01); *F17C 2201/0104* (2013.01); *F17C 2201/032* (2013.01); *F17C 2201/058* (2013.01); *F17C 2205/0188* (2013.01); *F17C 2205/0308* (2013.01); *F17C 2205/0329* (2013.01);

(Continued)

(58) Field of Classification Search
CPC ..... F17C 2201/0104; F17C 2201/0188; F17C 2201/0308; F17C 2201/0394; F17C 13/002
USPC ..... 220/763, 762, 756, 724, 741, 728; 137/382
See application file for complete search history.

(56) References Cited

U.S. PATENT DOCUMENTS 4,890,807 A * 1/1990 Desjardins ..... B44D 3/12 220/503
5,845,809 A * 12/1998 Garrett ..... F16K 35/10 220/728

FOREIGN PATENT DOCUMENTS

EP 2116332 A1 11/2009
EP 2586481 A1 5/2013

(Continued)

OTHER PUBLICATIONS

PCT International Preliminary Report on Patentability dated Sep. 15, 2016 from related pct App. No. 2015/053738, 6 pages.

(Continued)

*Primary Examiner* — King M Chu
(74) *Attorney, Agent, or Firm* — James E. Walton

(57) ABSTRACT

The invention is directed to a cover (4) for a tap of a gas cylinder (6), comprising a shell (7, 8) for housing the tap; and a hook (12) pivotally mounted on the shell (8), configured for securing the gas cylinder (6) to a horizontal bar (28). The shell (8) comprises reservations (30) on its external surface configured for receiving the hook (12) in a folded position so as to generally conform to said external surface. The invention is also directed to a gas storage assembly comprising a gas cylinder (6), a tap and a cover (4).

18 Claims, 3 Drawing Sheets

(52) U.S. Cl.
CPC ..... *F17C 2205/0332* (2013.01); *F17C 2205/0394* (2013.01); *F17C 2260/015* (2013.01); *F17C 2270/0745* (2013.01)

(56) References Cited

FOREIGN PATENT DOCUMENTS

| | | | |
|---|---|---|---|
| WO | 2013001190 | A1 | 1/2013 |
| WO | 2015036663 | A1 | 3/2015 |

OTHER PUBLICATIONS

International Search Report dated Sep. 9, 2015 for parent PCT application PCT/EP2015/053738.

* cited by examiner

COVER FOR GAS CYLINDER TAP

TECHNICAL FIELD

The invention is directed to a cover for a tap on a gas cylinder. The invention is also directed to a gas storage assembly comprising a gas cylinder, a tap and a cover on said tap.

BACKGROUND ART

Prior art patent document published EP 2 586 481 A1 discloses a cover for a tap of a gas cylinder. The cover is made of two half-shells that are joined on a vertical contact plane comprising the longitudinal axis of the cylinder. A hook is pivotally mounted on the cover and is intended to hang the gas cylinder to a structure while in use. The hook is mounted so as to freely hang downwards and contact the cylinder when not in use. During transport this contact can lead to undesirable noise. In addition, the ends of the hook can interfere in an unwanted manner when manipulating the gas cylinder. Also the cover comprises potentially sharp angles at the joining surfaces. The cover is also configured to be mounted on the cylinder tap after screwing said tap on the cylinder, thereby leading to time consuming operations.

Prior art patent document published WO 2013/001190 A1 discloses, similarly to the previous document, a protective cover for a tap of a gas cylinder. The cover includes two half-shells assembled together, the two half-shells defining a bottom base to be mounted at the neck of the cylinder, wherein the two half-shells are assembled along a vertical plane perpendicular to the base. The two half shells define, in the assembled position, at least one opening for accessing the inner protective space. It also includes, at a top end of the cap, a part for reinforcing and locking the two half-shells, the reinforcing and locking part including two ends coupled to the two half-shells, respectively. The reinforcing and locking part is generally beam-shaped and is mounted onto a frame formed by the half-shells, the frame covered by the reinforcing part consisting of a top handle for gripping the cap, both ends of the reinforcing and locking part being snap-coupled to the half-shells. A sliding and pivoting hook is provided on the cover. This hook is intended to fasten the gas cylinder to a horizontal bar of a bed, e.g. of a hospital bed. The hook is interesting in that the active ends of the two curved arms are connected by a transversal bar. The arms do not therefore present free ends that would potentially unintentionally hang at various objects in the surroundings of the cylinder. It can also be partially driven back into the cover. The curved ends of the arm and the transversal bar remain however outside of the cover and can therefore still interfere when manipulating the cylinder. Similarly to the cover of the previously discussed document, the present cover is also configured to be mounted on the cylinder tap after screwing said tap on the cylinder, thereby leading to time consuming operations.

The covers of the above discussed to documents are also quite bulky.

SUMMARY OF INVENTION

Technical Problem

The invention has for technical problem to provide an improved gas cylinder tap cover equipped with a hook. More particularly, the invention has for technical problem to provide a gas cylinder tap cover with a hook that is more convenient in use.

Technical Solution

The invention is directed to a cover for a tap of a gas cylinder, comprising: a shell for housing the tap; and a hook pivotally mounted on the shell, configured for securing the gas cylinder to a horizontal bar; wherein the shell comprises reservations on its external surface configured for receiving the hook in a folded position so as to generally conform to said external surface.

According to a preferred embodiment of the invention, the hook comprises two arms pivotally mounted at one end on the shell and linked together by a connecting bar, said arms extending in an arcuate manner from their pivot ends until a vertical half portion of the shell that is opposite to the pivot when said hook is in the folded position.

According to a preferred embodiment of the invention, the connection bar comprises hand gripping means for facilitating unfolding of the hook, said gripping means preferably comprising a cut-out in said bar.

According to a preferred embodiment of the invention, the shell comprises an upper half-shell and a lower half-shell, said half-shells being joined together along a contact plane that forms an angle comprised between 30° and 60° with a vertical direction, said angle being preferably comprised between 40° and 50°.

According to a preferred embodiment of the invention, the hook is pivotally mounted on the lower half-shell, said half-shell comprising the reservations receiving said hook in the folded position.

According to a preferred embodiment of the invention, the upper half-shell comprises a handle that extends essentially horizontally over a wall of said shell that is configured for housing the tap.

According to a preferred embodiment of the invention, the upper half-shell comprises a first upper opening for accessing a flow selector of the tap and a lower opening for a accessing a gas outlet of said tap.

According to a preferred embodiment of the invention, both the upper and lower half-shell form, in a complementary manner, at least one side opening at the level of the contact plane, said opening being intended for accessing a shut-off valve of the tap, a connecting port and/or a refill port.

According to a preferred embodiment of the invention, both the upper and lower half-shell form, in a complementary manner, one side opening on each of both sides of the cover.

According to a preferred embodiment of the invention, the upper half-shell is generally spherically shaped.

According to a preferred embodiment of the invention, the contact plane between the upper and lower half-shells has an upper portion at a rear side of the cover, the hook being pivotally mounted on said rear side of said shell.

According to a preferred embodiment of the invention, the lower half-shell is configured to extend from an upper rear side to a lower front side of the shell, and comprises an opening for receiving a neck of the gas cylinder.

According to a preferred embodiment of the invention, the lower half-shell comprises a rear side where the hook is pivotally mounted, said rear side comprising a generally flat portion for contacting the horizontal bar.

According to a preferred embodiment of the invention, the hook is made of plastic, aluminium or composite material.

According to a preferred embodiment of the invention, the hook comprises arcuate arms with a plain section preferably of more than 40 $mm^2$, more preferably more than 50 $mm^2$, even more preferably more than 60 $mm^2$.

According to a preferred embodiment of the invention, the hook comprises arcuate arms with a generally triangular shaped cross-section.

According to a preferred embodiment of the invention, the hook comprises arms that extend, preferably essentially over their whole length, in an arcuate manner with an essentially constant radius over a sector that is comprised between 120° and 200°, preferably between 150° and 180°.

The invention is also directed to a gas storage assembly, comprising: a gas cylinder with a neck portion; a tap fixed to said neck portion; a cover over said tap; wherein the cover is in accordance with the invention.

According to a preferred embodiment of the invention, the tap comprises a flow selector on an upper portion, a gas outlet on a lower portion and at least one of a shut-off valve, a connecting port and a refill port on a side portion, the cover comprising an upper opening, a lower opening and a side opening providing access to said flow selector, gas outlet and shut-off valve, connecting and/or refill port, respectively.

Advantages of the Invention

The invention is particularly interesting in that it provides a compact cover with a hook that is easy to use and that does not cause problem in running the risk to unintentionally hang to objects in the surroundings of the cylinder, e.g. during its manipulation. In addition, the construction with two half-shells with an inclined contact plane is particularly interesting in that it provides reduced manufacturing and assembly costs.

DESCRIPTION OF AN EMBODIMENT

Figure 1:
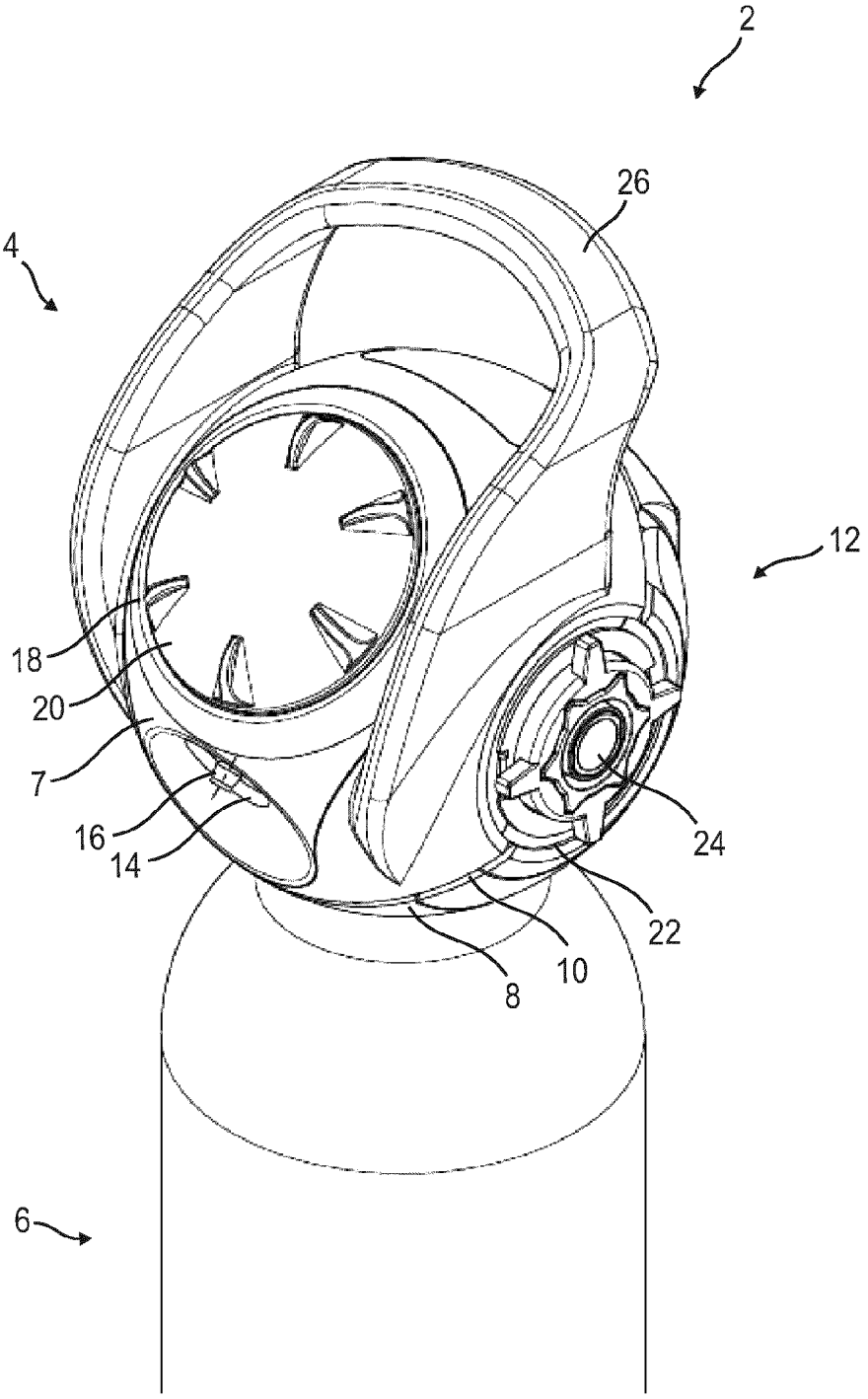
FIG. 1 is a perspective view of a gas storage assembly in accordance with the invention and where the hook is in a folded position.

FIG. 1 is a perspective view of a gas storage assembly in accordance with the invention. The assembly 2 comprises a gas cylinder 6 with a tap (not visible) and a cover 4 housing said tap. The cover 4 comprises a shell that is constituted essentially of two half-shells, namely an upper half-shell 7 and a lower half-shell 8. Both half-shells 7 and 8 are joined together by a contact plane 10 that is generally inclined with regard to the vertical and horizontal directions. This inclination is better visible in FIGS. 3 and 4 which are side views and will be discussed more in details in relation with these figures.

The cover 4 comprises also a hook 12 that is in a folded position in FIG. 1. The hook will be described with more details in relation with FIGS. 2 to 4.

The upper half-shell 7 comprises a lower opening 14 for a gas outlet 16 of the tap. It comprises also an upper opening 18 that is covered by a rotatable wheel 20 for actuating a flow selector of the tap.

The upper and lower half-shells 7 and 8 comprise each a cut-out at the edge of their contact plane, these cut-out forming in a complementary manner a side opening 22 for a connecting port with a peripheral hand-wheel 24 for actuating a shut-off valve of the connecting port. The tap can indeed comprise, in addition to the gas outlet 16, a connecting port 24 which is directly fluidly connected to the pressure reducer of the tap. The shell can also comprise a second side opening, on the opposite side and similar to the side opening 22. This second side opening can provide access to a refill port.

The upper half-shell 7 comprises also a handle 26 that extends essentially horizontally above the wall of said shell 7 housing the tap.

Figure 2:
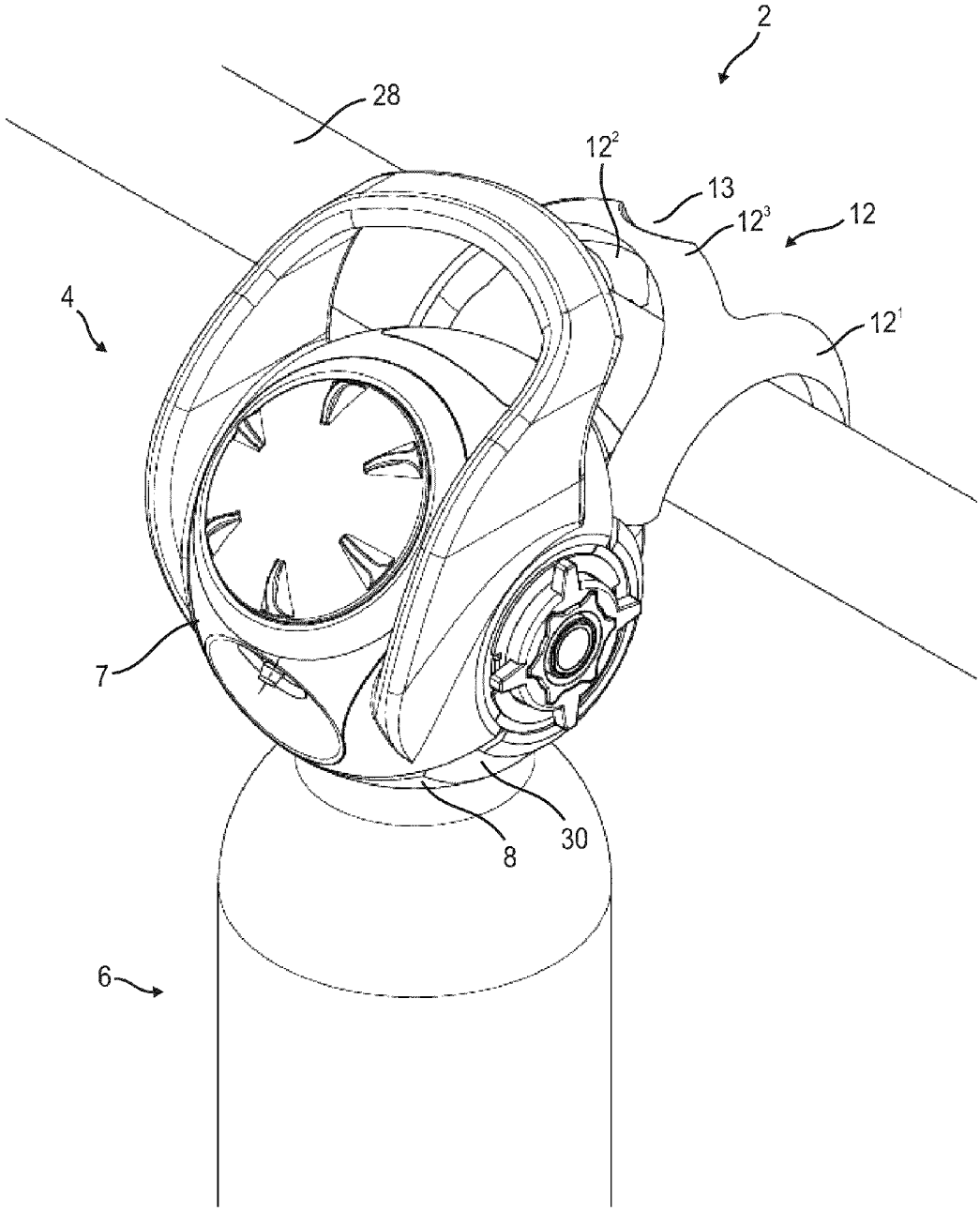
FIG. 2 a perspective view of the assembly of FIG. 1 where however the hook is in an unfolded position, engaging with a horizontal bar.

FIG. 2 is a perspective view of a gas storage assembly of FIG. 1 where the hook 12 is in an unfolded position, engaging with a horizontal bar 28, like the side bar of a hospital bed.

The hook 12 is pivotally mounted on a rear and upper portion of the lower half-shell 8. The pivot axis (not represented as such) is generally horizontal, or in other words generally perpendicular to the longitudinal axis of the cylinder.

Figure 3:
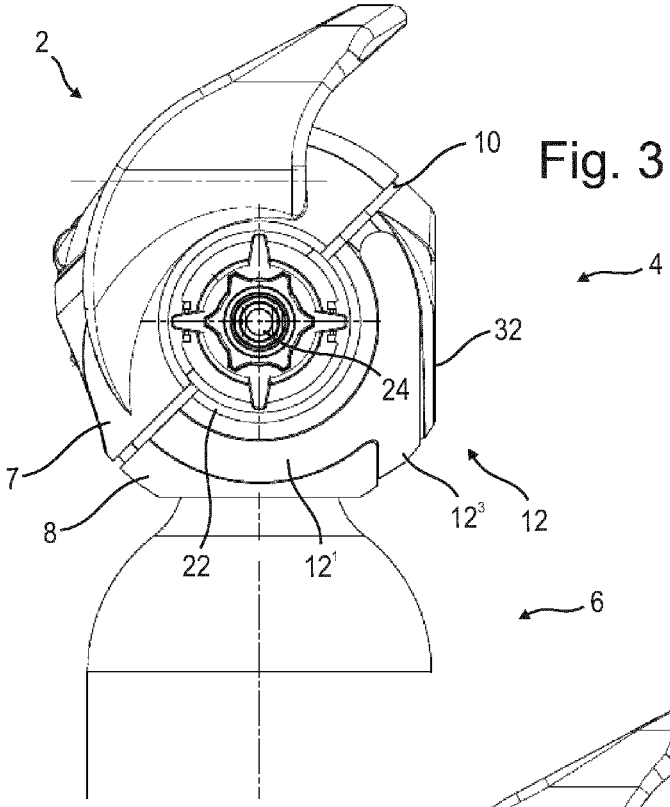
FIG. 3 is a side view of the assembly of FIGS. 1 and 2, the hook being in the folded position.

The hook 12 comprises two arcuate arms $\mathbf{12}^1$ and $\mathbf{12}^2$, and a transverse bar or arm $\mathbf{12}^3$ that interconnects the two arms. The arms $\mathbf{12}^1$ and $\mathbf{12}^2$ extend essentially parallel to each other from the pivot axis to free ends of said arms. The interconnecting bar $\mathbf{12}^3$ extends between intermediate portions of each arm $\mathbf{12}^1$ and $\mathbf{12}^2$. The hook is preferably made as a single piece of plastic material, e.g. by plastic moulding. The interconnecting bar $\mathbf{12}^3$ can comprise a cut-out 13 for facilitating its hand gripping when unfolding the hook from its folded position (as illustrated in FIGS. 1 and 3).

The arms $\mathbf{12}^1$ and $\mathbf{12}^2$ and possibly the bar $\mathbf{12}^3$ can have a section of plain material. The section of these elements is preferably essentially triangular. The cross-section of these elements is preferably of more than 40 $mm^2$, more preferably more than 50 $mm^2$, even more preferably more than 60 $mm^2$ so as to provide enough rigidity, e.g. when made of plastic.

As is partly visible in FIG. 2, the lower half-shell 8 comprises reservations 30 or extended cavities on its external surface for receiving the arms $\mathbf{12}^1$ and $\mathbf{12}^2$ of the hook. These reservations are better visible in FIGS. 3 and 4 and will be described more in details in relation with these figures.

The wall of the upper half-shell 7 is preferably generally spherically shaped. The lower half-shell 8 can be more rectangular shaped as is visible in FIGS. 3 and 4.

Figure 4:
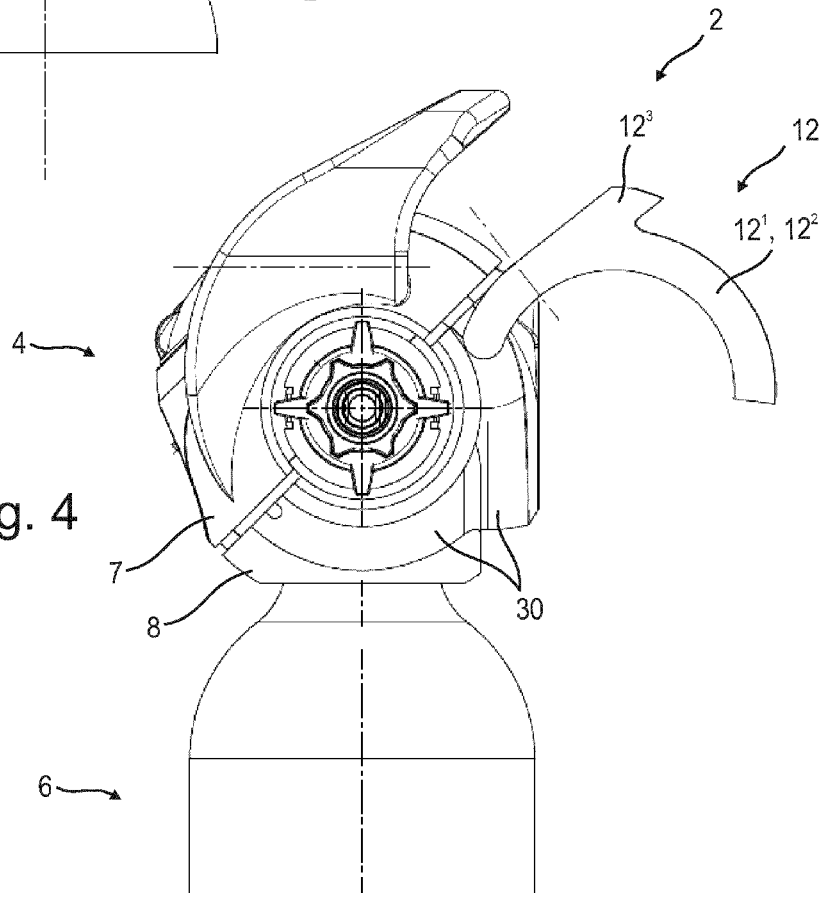
FIG. 4 is a side view of the assembly of FIGS. 1 and 2, the hook being in the unfolded position.

FIGS. 3 and 4 are side views of the assembly of FIGS. 1 and 2, where in FIG. 3 the hook is folded and in FIG. 4 the hook is unfolded. In both FIGS. 3 and 4, the contact plane 10 between the two half-shells 7 and 8 is clearly visible. It forms an angle with the vertical or longitudinal direction of the cylinder that is comprised between 30° and 60°, preferably between 40° and 50°. The arms $\mathbf{12}^1$ and $\mathbf{12}^2$ of the hook 12 extend in an arcuate manner with an essentially constant radius from theirs ends at the pivot axis to the opposite free ends, and this over a sector that can be comprised between 120° and 200°, preferably between 150° and 180°. As is visible in FIG. 3, the radius of the arms $\mathbf{12}^1$ and $\mathbf{12}^2$ of the hook 12 is centred essentially at the axis of the side opening 22 and of the hand-wheel 24 of the shut-off valve. The arms can therefore nicely engage in the reservations 30 of the lower half-shell 8 so that the external visible surface of the hook essentially conforms to the adjacent external surface of the half-shell. This matter of fact is visible in FIG. 3 for the interconnecting bar $12^3$.

The rear face 32 of the lower half-shell 8 is generally flat. This face is the one contacting the bar 28 (FIG. 2) that is to be engaged by the hook 12.

As is visible in FIG. 4, the pivoting range of the hook can be comprised between 90° and 180°, preferably between 110° and 150°.

The lower half-shell 8 comprises a lower opening (not visible) through which the neck of the cylinder extends. The cover 4 is preferably assembled to the tap for form a unit, this unit being then afterwards mounted on the cylinder, e.g. by screwing. To that end, the tap can comprise surfaces that are contacted by portions of the internal surface of the half-shells, such that the shell is rigidly assembled with the tap. Both half-shells 7 and 8 are preferably fixed to each other by screwing. Both half-shells can be manufactured by plastic injection moulding.

The invention claimed is:

1. A cover for a tap of a gas cylinder, comprising:
a shell for housing the tap; and
a hook pivotally mounted on the shell, configured for securing the gas cylinder to a horizontal bar;
wherein the shell comprises:
reservations on the external surface, the reservations forming elongate cavities, the reservations configured for receiving the hook in a folded position only, so that said hook generally conforms to said external surface adjacent to said reservations.

2. The cover according to claim 1, wherein the hook comprises:
two arms pivotally mounted at one end on the shell and linked together by a connecting bar, said arms extending in an arcuate manner from the pivot ends thereof until a vertical half portion of the shell that is opposite to the pivot when said hook is in the folded position.

3. The cover according to claim 2, wherein the connection bar comprises:
hand gripping means for facilitating unfolding of the hook, said gripping means comprising:
a cut-out in said bar.

4. The cover according to claim 1, wherein the shell comprises:
an upper half-shell and a lower half-shell, said half-shells being joined together along a contact plane that forms an angle with a vertical direction comprised of one of the following ranges:
between 30° and 60°; and
between 40° and 50°.

5. The cover according to claim 4, wherein the hook is pivotally mounted on the lower half-shell, said lower half-shell comprising:
the reservations receiving said hook in the folded position.

6. The cover according to claim 4, wherein the upper half-shell comprises:
a handle that extends essentially horizontally over a wall of said shell that is configured for housing the tap.

7. The cover according to claim 4, wherein the upper half-shell comprises:
an upper opening for accessing a flow selector of the tap; and
a lower opening for a accessing a gas outlet of said tap.

8. The cover according to claim 4, wherein both the upper and lower half-shells form, in a complementary manner, a side opening at the contact plane, said opening being intended for accessing a connecting port of the tap.

9. The cover according to claim 4, wherein the upper half-shell is generally spherically shaped.

10. The cover according to claim 4, wherein the contact plane between the upper and lower half-shells has an upper portion at a rear side of the cover, the hook being pivotally mounted on said rear side of said shell.

11. The cover according to claim 4, wherein the lower half-shell is configured to extend from an upper rear side to a lower front side of the shell, and comprises:
an opening for receiving a neck of the gas cylinder.

12. The cover according to claim 4, wherein the lower half-shell comprises:
a rear side where the hook is pivotally mounted, said rear side comprising:
a generally flat portion for contacting the horizontal bar.

13. The cover according to claim 1, wherein the hook is made of a material comprising:
plastic;
aluminium; or
composite material.

14. The cover according to claim 1, wherein the hook comprises:
arcuate arms having a plain section of more than one of the following:
40 $mm^2$;
50 $mm^2$; and
60 $mm^2$.

15. The cover according to claim 1, wherein the hook comprises:
arcuate arms with a generally triangular shaped cross-section.

16. The cover according to claim 1, wherein the hook comprises:
arms that extend, essentially over the whole length thereof, in an arcuate manner with an essentially constant radius over a sector that is comprised between one of the following:
120° and 200°; and
150° and 180°.

17. A gas storage assembly, comprising:
a gas cylinder with a neck portion;
a tap fixed to said neck portion;
a cover over said tap, the cover comprising:
a shell for housing the tap; and
a hook pivotally mounted on the shell, configured for securing the gas cylinder to a horizontal bar;
wherein the shell comprises:
reservations on the external surface thereof configured for receiving the hook in a folded position, so as to generally conform to said external surface.

18. The gas storage assembly according to claim 17, wherein the tap comprises:
a flow selector on an upper portion;
a gas outlet on a lower portion;
at least one of a connecting port;
a refill port; and
a shut-off valve on a side portion;
wherein the cover comprises:
an upper opening;
a lower opening; and a side opening providing access to said flow selector, gas outlet and connecting port, refill port and/or shut-off valve, respectively.

* * * * *